US005291946A

United States Patent [19]

Ciriaci

[11] Patent Number: 5,291,946

[45] Date of Patent: Mar. 8, 1994

[54] CARRIER ASSEMBLY FOR USE IN A VERTICAL BLIND ASSEMBLY

[75] Inventor: Piergiorgio Ciriaci, Hollywood, Fla.

[73] Assignee: Micro Molds Corp., Miami, Fla.

[21] Appl. No.: 14,238

[22] Filed: Feb. 5, 1993

[51] Int. Cl.[5] ..... E06B 9/26

[52] U.S. Cl. ..... 160/177

[58] Field of Search ..... 160/177, 176.1, 168.1, 160/173, 172, 178.1, 900

[56] References Cited

U.S. PATENT DOCUMENTS

| | | | |
|---|---|---|---|
| 3,280,891 | 10/1966 | Eldredge et al. | 160/176.1 X |
| 4,122,884 | 10/1978 | Salzmann | 160/168.1 |
| 4,628,981 | 12/1986 | Ciriaci et al. | 160/176.1 |
| 4,834,163 | 5/1989 | Dickstein | 160/177 X |
| 4,848,435 | 7/1989 | Helver | 160/176.1 |
| 4,967,823 | 11/1990 | Gagnon | 160/177 |
| 5,056,578 | 10/1991 | Helver | 160/177 |

*Primary Examiner*—David M. Purol
*Attorney, Agent, or Firm*—Robert M. Downey

[57] ABSTRACT

To be used in a vertical blind assembly, a carrier assembly including a plurality of carrier members, each member having a carrier frame with an axial bore extending therethrough, a transverse gear track tangentially disposed beneath the axial bore and a generally C-shaped attachment member perpendicularly disposed along a lower edge of the carrier frame, and a stem member having a vane holder portion and a drive gear rotatably disposed within the generally C-shaped attachment member. The vane holder portion and the drive gear portion being interconnected with one another such that each is independently rotatable and the vane holder portion is further adapted to have a limited range of rotation relative to the drive gear, thereby enabling complete alignment of all vanes. The carrier assembly further includes an axial pinion rod extending through the axial bore of each of the carrier members so as to engage a first set of gear teeth disposed along a top edge of a horizontal rack gear slidably positioned within the transverse gear track of the carrier frame. The horizontal rack gear is prevented from vertically tilting within the gear track upon rotation of the pinion rod by a protruding ridge along a rear face thereof which is slidably disposed within an elongate groove in the transverse gear track, thereby assuring that movement is fluid and uninterrupted.

4 Claims, 2 Drawing Sheets

CARRIER ASSEMBLY FOR USE IN A VERTICAL BLIND ASSEMBLY

BACKGROUND OF THE INVENTION

1. Field of the Invention

The present invention relates to a carrier assembly for use in a vertical blind assembly adapted to enable facilitated alignment of all vanes of a blind assembly and smooth and uniform rack gear movement within, thereby providing a carrier assembly which is longlasting, enhances the appearance of a vertical blind assembly as a result of the proper orientation of all vanes, and is easily maneuverable.

2. Description of the Related Art

Known in the art are numerous types of vertical blind assemblies, each using a plurality of carriers to hold individual vanes of the vertical blind. Generally, these carriers serve the dual function of spreading the vanes out along a surface to be covered and providing a pivot upon which the individual vane may turn between an open and closed position. The pivotal movement of all of the vanes is generally achieved through the use of a pinion rod which passes through all of the carriers. This pinion rod is normally one of two types, one which when turned, activates a worm gear within the carrier, and a second which includes a plurality of ridged protrusions disposed about the periphery thereof to engage a rack gear. The second type is the more commonly used, however, a primary difficulty encountered with the second type of pinion rod is that during manufacturing, the extrusion process utilized to make the rods often leads to a deviation or "twist" in the ridges on the periphery of the rod. As a result of this "twist," when the vanes are opened and closed, those vanes towards an end of the pinion rod tend to be misaligned relative to the remaining vanes, thereby detracting the uniform appearance of the blind assembly and providing gaps through which vision or light is not obstructed. Accordingly, it would be highly beneficial to provide a carrier assembly which enabled facilitated alignment of the individual vanes such that use of a twisted pinion rod will not result in misalignment. Additionally, most carriers which utilize the pinion rod and rack gear are susceptible to vertical tilting of the rack gear as only a small portion of the rack gear is contacted by the pinion rod which when turned tends to make the rack gear tilt. This tilting of the individual rack gears, although seemingly small, when affecting a number of carriers, results in a difficulty of pivoting all the vanes, and results in increased wear to the individual assembly. Accordingly, it would also be highly beneficial to have a carrier assembly which enables the rack gear to be effectively utilized while maintaining the gear properly aligned so as to facilitate the movement thereof.

The present invention specifically provides for facilitated alignment of all of the vanes should a twist in the pinion rod result in an initial misalignment, and for the protection of the mechanism if one or more of the vanes become overlapped or entangled with each other or with an outside factor. Further, by providing the rack gear with a ridge and groove engagement, the movement of the gears is uniform and not unnecessarily difficult. The combination of a slip clutch-type assembly, to enable alignment, stop means on the stem whereon the vane is supported, to assure that over compensation will not occur, and a ridge and groove engagement of the rack gear with the carrier frame, to assure smooth, fluid movement and added stability, provide a needed improvement in the field of vertical blind assemblies with an easy to activate, cost-effective, and alignable carrier assembly.

SUMMARY OF THE INVENTION

The present invention is directed towards a carrier assembly to be used in a vertical blind assembly having an elongate track casing with a top, opposite side walls and opposite end walls disposed in surrounding relation to a longitudinal channel extending along the length thereof, and a pair of inwardly disposed guide tracks confrontingly disposed along the opposite side walls of the channel. The carrier assembly includes a plurality of carrier members, all movably disposed within the channel and supportably held between the guide track. Each of the carrier members primarily includes a carrier frame with an axial bore extending therethrough and a transverse gear track tangentially disposed beneath the axial bore. Further, the carrier frame includes a generally C-shaped attachment member which is perpendicularly disposed along a lower edge of the carrier frame. The C-shaped attachment member is adapted to rotatably hold an elongate stem member therein. The stem member includes two parts, namely a vane holder portion and a drive gear. The vane holder portion extends downwardly from the carrier frame, thereby protruding from the longitudinal channel of the elongate track casing, and is adapted to removably hold an upper end of a vane of the blind assembly. The proximal upper end of the vane holder portion is structured and disposed to be pivotally interconnected with the drive gear, thereby enabling the vane holder portion to be independently rotatable relative to the drive gear. Also, stop means are disposed on the vane holder portion so as to limit the rotation of the vane holder portion of the stem member while allowing continued rotation of the drive gear. These stop means enable alignment of all the vanes held in each carrier member by ceasing the rotation of the vane member in a fully closed position and allowing continued movement of the drive gear such that the drive gear and vane holder portion of a misaligned carrier member will continue to rotate until achieving the proper orientation. Disposed within the transverse gear track of the carrier frame is a horizontal rack gear. The rack gear includes a top edge, a front face, and a rear face, the top edge having a first set of gear teeth extending therealong and the front face including a second set of gear teeth extending therealong. The rack gear is disposed within the transverse gear track such that a portion of the first set of gear teeth extends into the axial bore in the carrier frame and such that a portion of the second set of gear teeth extends into the generally C-shaped attachment member so as to engage the drive gear on the stem. The rack gear moves by means of an axial pinion rod which extends through the axial bore in the carrier frame of each of the carrier members. The pinion rod has a plurality of radially extending, elongate axial ridges disposed about a periphery thereof, the ridges being adapted to engage the first set of gear teeth on the top edge of the horizontal rack gear, thereby resulting in lateral movement of the rack gear within the transverse gear track upon rotation of the pinion rod. In order to assure that the rack gear moves uniformly within the track and is not subject to vertical tilting as a result of the rotation of the pinion rod engaging the rack gear, a protruding ridge extends across substantially the entire rear face of the rack gear and is slidably disposed within an elongate groove in the transverse gear track. Finally, so as to facilitate normal functioning of the vertical blind assembly, means to rotate the pinion rod, means interconnecting adjacently positioned carrier members, and means to move the carrier members along the guide channel are included.

It is an object of the present invention to provide a smooth moving carrier assembly which will enable a pinion rod having elongated ridges disposed about the periphery thereof to be effectively utilized without resulting in tilting of the rack gear of an individual carrier member.

A further object of the present invention is to provide a carrier assembly wherein each individual carrier member may be easily positioned and wherein the vanes held by each of the individual carrier members may be completely aligned through the rotation of the pinion rod, thereby eliminating the need for individual alignment of a particular vane.

Yet another object of the present invention is to provide a carrier member which while providing for facilitated alignment of all vanes and assuring smooth fluid movement does not require expensive adaptation of commonly employed vertical blind assemblies in order to utilize the improved carrier members.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
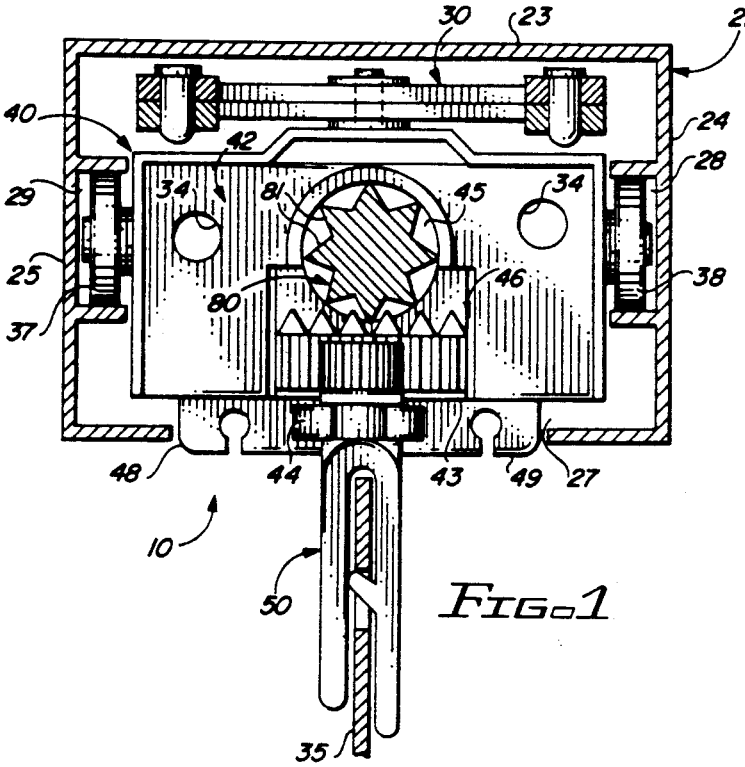
FIG. 1 is a front view of a carrier member disposed within a track casing of a vertical blind assembly.
Figure 2:
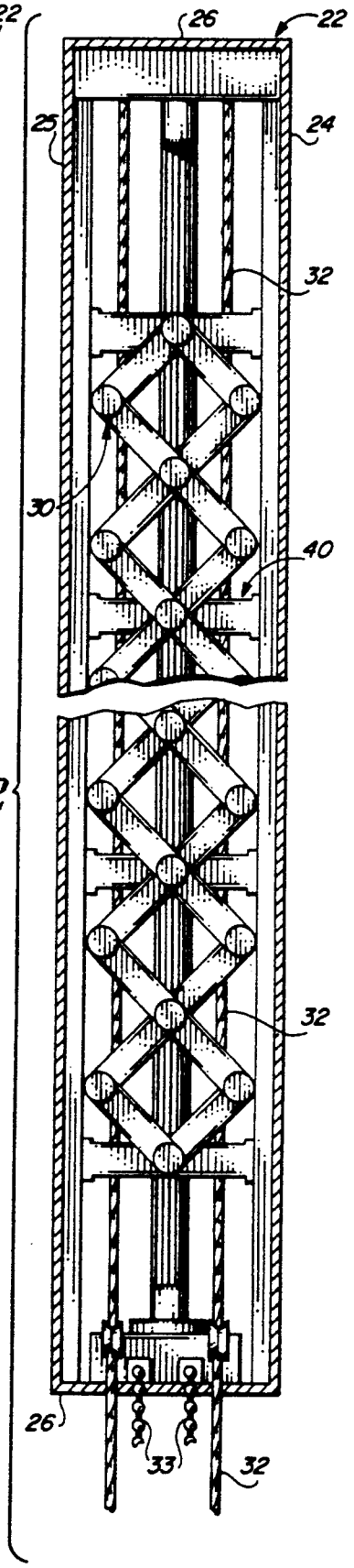
FIG. 2 is a top view of a vertical blind assembly utilizing a carrier assembly of the present invention.
Figure 3:
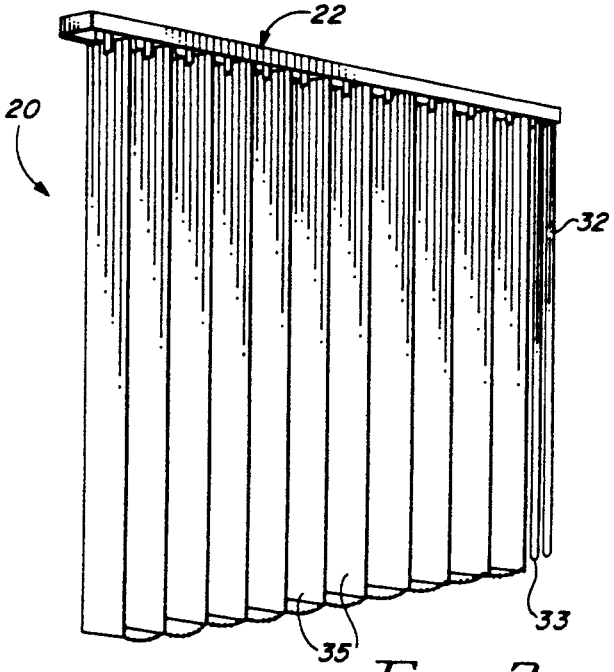
FIG. 3 is a perspective view of the vertical blind assembly utilizing the carrier assembly of the present invention.
Figure 4:
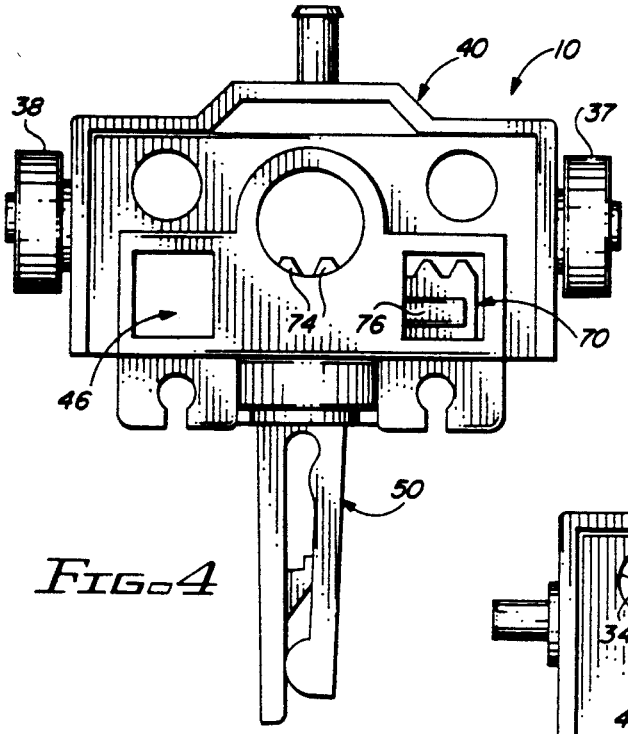
FIG. 4 is a rear view of a carrier member of the carrier assembly of present invention.

Shown throughout FIGS. 1–9, the present invention is directed towards a carrier assembly, generally indicated as 10, for use in a vertical blind assembly 20. The vertical blind assembly 20, as detailed in FIGS. 1, 2 and 3, is of the type including an elongate track casing 22 having a top 23, opposite side walls 24 and 25, and opposite end walls 26 disposed in surrounding relation to a longitudinal channel 27 extending along a length thereof. Confrontingly disposed along the side walls 24 and 25 are a pair of inwardly disposed guide tracks 28 and 29. The guide tracks 28 and 29 are adapted to slidably hold the carrier assembly 10 therein. The carrier assembly 10 primarily includes a plurality of carrier members 40 from which a plurality of vanes 35 are hung. Each of the carrier members 40 are engaged with one another by an elongate scissor connector 30 which is secured to each of the carrier members 40 and enables the carrier members 40 to be spaced apart or pulled together during the opening and closing of the vertical blind assembly 20, by the pulling of a draw string 32.

Turning to FIGS. 1 and 4–9, each of the carrier members 40 of the carrier assembly 10 includes primarily a carrier frame 42. The carrier frame 42 is generally rectangular in shape and includes a pair of bearing wheels 37 and 38 disposed on opposite ends thereof. These bearing wheels 37 and 38 are adapted to be fitted within the guide tracks 28 and 29 of the track casing 22 so as to enable each of the carrier members 40 to move longitudinally along the casing. Additionally, in order to facilitate the longitudinal movement of the carrier members 40, each of the carrier frames 42 includes a pair of openings 34 therein to enable the cord 32 to pass therethrough. More importantly, the carrier frame 42 includes an axial bore 45 through which there is extended a pinion rod 80.

Figure 6A:
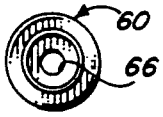
FIG. 6A is a bottom view of the drive gear of the stem member.
Figure 6B:
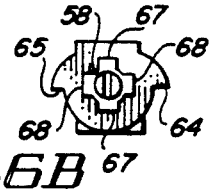
FIG. 6B is a top view of the vane holder portion of the stem member.
Figure 5:
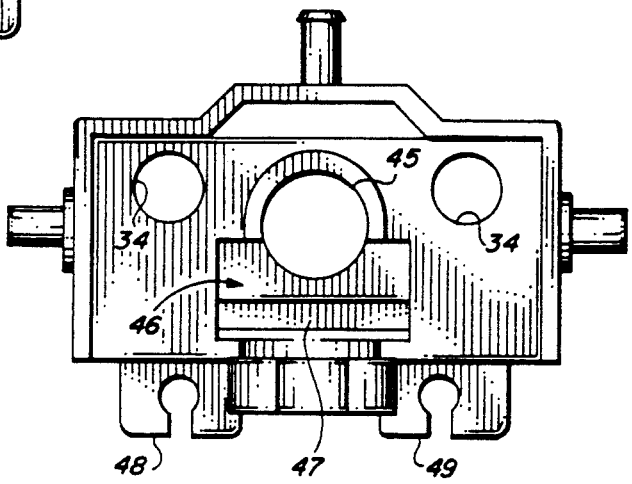
FIG. 5 is a front view of the carrier frame.
Figure 6:
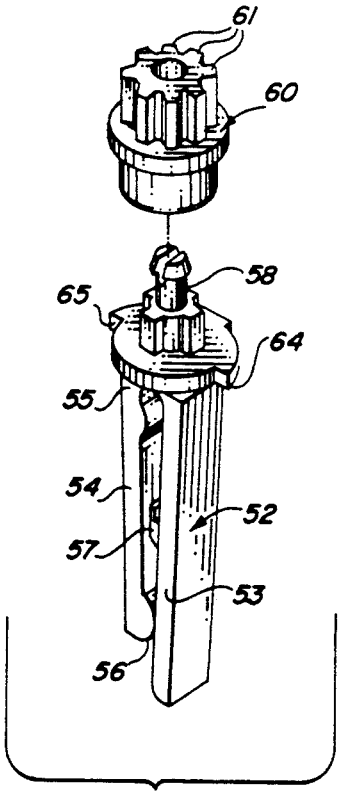
FIG. 6 is an exploded view of a stem member.
Figure 7:
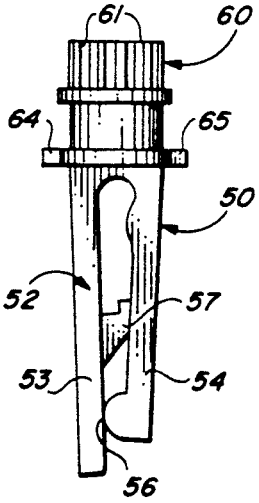
FIG. 7 is a side view of the stem member.
Figure 8:
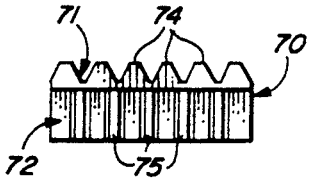
FIG. 8 is a front view of the rack gear.
Figure 9:
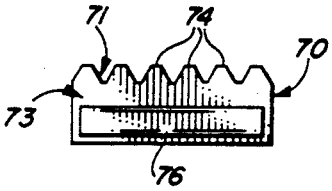
FIG. 9 is a rear view of the rack gear of the carrier assembly of the present invention.

Perpendicularly disposed along a lower edge 43 of the carrier frame 42 is a generally C-shaped attachment member 44. This attachment member 44 is adapted to receive therein a stem member 50. The stem member 50 is snap fitted into the attachment member 44 such that it will be securely held therein, while being able to freely rotate. The stem member 50 is composed of two portions, namely a vane holder portion 52 and a drive gear 60. The vane holder portion 52 includes a bifurcated lower distal end 56 having a pair of grasping arms 53 and 54 between which an individual vane 35 is held. For added security, a hook member 57 is included on one of the grasping arms 53 to hook into the vane 35. This vane holder portion 52 is adapted to protrude from the track casing 22 thereby providing for free rotation of the individual vanes 35. Extending from a proximal end 55 of the vane holder portion 52 is the proximal, upper attachment end portion 58 whereon the drive gear 60 is rotatably disposed. More particularly, the upper attachment end portion 58 includes two pairs of friction ridges 67 and 68, as best seen in FIG. 6B, which are adapted to be received within an axial passage 66 in the drive gear 60. The drive gear 60 and vane holder portion 52 are secured to one another such that both may rotate independently of one another, yet generally rotate together as a result of the friction between the ridges 67 and 68 and an interior of the axial passage 66 of the drive gear 60. Further, one pair of friction ridges 67 are sized and disposed to be slightly longer than an interior diameter of the axial passage 66 of the drive gear 60 such that the axial passage 66 is stretched to provide an increased friction hold between the ridges 67 and 68 and the drive gear 60 until independent rotation is required, thereby defining a friction clutch. The independent rotation of the vane holder 52 relative to the gear 60 achieved by the friction clutch enables alignment of all vanes 35 of the blind assembly 20. This is due to the continued rotation of each vane holder 52 until all vane holders on respective carrier assembly have reached a stop point resulting in proper alignment. The vane holder portion 52 includes stop means in the form of a pair of protruding stopper members 64 and 65 at the proximal end 55 of the vane holder portion 52. These stop members 64 and 65 are adapted to contact panel 49 of the carrier frame 42 when the vane 35 is disposed in a fully closed orientation, defining the stop point. Subsequent to contact of the stop members 64 or 65 with the carrier frame 42, the vane 35 remains in the fully closed orientation, while the drive gear 60 is enabled to continue moving, thereby freely allowing the pinion rod 80 to continue moving so as to properly orient remaining stem members 50 of subsequent carrier members 40 having misaligned vanes 35.

Centrally disposed in the frame 42 is a transverse gear track 46, tangentially disposed along the lower edge of the axial bore 45. This transverse gear track 46 is adapted to hold therein a rack gear 70. The rack gear 70 includes a top edge 71, a front face 72, and a rear face 73, and is disposed within the gear track 46 such that a first set of gear teeth 74, which protrude from the top edge 71 of the rack gear 70 into the axial bore 45. Additionally, the rack gear 70 is disposed such that a second set of gear teeth 75, disposed on the front face 72 of the rack gear 70, extend into the generally C-shaped attachment member 44. The second set of gear teeth 75 are adapted to engage plurality of gear teeth 61 disposed on the drive gear 60 such that lateral movement of the rack gear 70 within the gear track 46 will result in corresponding rotation of the drive gear 60 and the stem member 50. In order to assure that the rack gear 70 moves smoothly within the gear track 46 and does not vertically tilt, a protruding ridge 76 extends along the rear face 73 of the rack gear 70. This protruding ridge 76 is adapted to be slidingly positioned within an elongate groove 47 which extends along the length of the gear track 46. Accordingly, no matter what portion of the first set of gear teeth 74 is contacted by the pinion rod 80, the rack gear 70 will move transversely without tilting. The pinion rod 80 engages the rack gear 70 by a plurality of radially extending, elongate axial ridges 81 which are disposed about the periphery of the pinion rod 80. As with most standard vertical blind assemblies 20, the pinion rod 80 is rotated as a result of a pull chain 33 secured to an end thereof.

Now that the invention has been described, I claim:

1. A carrier assembly for use in a vertical blind assembly of the type including an elongate track casing having a top, opposite side walls, and opposite end walls disposed in surrounding relation to a longitudinal channel extending along a length thereof, and a pair of inwardly disposed guide tracks confrontingly disposed along said opposite side walls of said channel, said carrier assembly comprising:

a plurality of carrier members movably disposed within said channel, each of said carrier members being supportably held between said guide tracks, each of said carrier members including:

a carrier frame, said carrier frame having an axial bore extending therethrough, a transverse gear track tangentially disposed along a lower edge of said axial bore, and a generally C-shaped attachment member perpendicularly disposed along a lower edge of said carrier frame, a stem member rotatably secured within said generally C-shaped attachment member, said stem member including a vane holder portion and a drive gear, said vane holder portion extending downwardly from said carrier frame so as to protrude from said longitudinal channel, said vane holder portion having a bifurcated lower distal end portion, structured and disposed to removably an upper end of a vane, and a proximal, upper end structured and disposed to be pivotally interconnected with said drive gear such that said vane holder portion is independently rotatable relative to said drive gear, stop means disposed on said vane holder portions, said stop means being structured and disposed to limit rotation of said vane holder portion of said stem member while allowing continued rotation of said drive gear, a horizontal rack gear slidably disposed within said transverse gear track, said rack gear having a top edge, a front face and a rear face, said top edge including a first set of gear teeth extending therealong, and said front face including a second set of gear teeth extending therealong, said horizontal rack gear being disposed such that a portion of said first set of gear teeth extends into said axial bore and a portion of said second set of gear teeth extend into said generally C-shaped attachment member so as to engage said drive gear on said stem, an axial pinion rod extending through said axial bore in said carrier frame of each of said carrier members, said pinion rod having a plurality of radially extending, elongate axial ridges disposed about a periphery thereof, said ridges being structured and disposed to engage said first set of gear teeth along said top edge of said horizontal rack gear such that rotation of said pinion rod results in corresponding lateral movement of said rack gear within said transverse gear track, said rack gear including a protruding ridge extending across said rear face thereof, said ridge being slidably disposed within an elongate groove in said transverse gear track, thereby preventing vertical tilting of said rack gear within said transverse gear track, means to rotate said pinion rod, means interconnecting adjacently positioned carrier members, and means to move said carrier members along said guide channel.

2. A carrier assembly as recited in claim 1 wherein said stop means includes a pair of stop members protruding from opposite sides of said proximal upper end of said vane holder portion of said stem member, said stop members being structured and disposed to contact said carrier frame and stop the rotation of said vane holder portion of said stem member, while allowing said drive gear to continue rotating, upon said vane held by said vane holder portion being disposed in a fully closed orientation.

3. A carrier assembly as recited in claim 1 wherein said bifurcated lower distal end portion of said vane holder portion of said stem member includes a pair of oppositely disposed, biased grasping arms structured and disposed to grasp said vane.

4. A carrier assembly as recited in claim 3 wherein one of said grasping arms of said bifurcated lower distal end portion of said vane holder portion includes an inwardly protruding hook segment structured and disposed to supportably hold said vane thereon.

* * * * *